US005460281A

United States Patent [19]

Rapchak et al.

[11] Patent Number: 5,460,281

[45] Date of Patent: Oct. 24, 1995

[54] SAFETY LOCK SCREW CAP AND CONTAINER

[75] Inventors: Thomas P. Rapchak; Michael Marino, both of New Castle, Pa.

[73] Assignee: West Penn Plastics, New Castle, Pa.

[21] Appl. No.: 306,395

[22] Filed: Sep. 15, 1994

[51] Int. Cl.[6] ..... B65D 55/12

[52] U.S. Cl. ..... 215/216; 215/264; 215/335

[58] Field of Search ..... 215/201, 214, 215/215, 216, 217, 218, 219, 220, 284, 329, 330, 335, 336, 221

[56] References Cited

U.S. PATENT DOCUMENTS

| | | | |
|---|---|---|---|
| 3,233,769 | 2/1966 | Jessop . | |
| 3,399,796 | 9/1968 | Steiner | 215/216 |
| 3,698,584 | 10/1972 | Miller | 215/216 |
| 3,895,730 | 7/1975 | Koehne et al. | 215/216 |
| 3,924,769 | 12/1975 | Fillmore | 215/330 X |
| 3,941,268 | 3/1976 | Owens et al. . | |
| 3,944,101 | 3/1976 | Landen et al. . | |
| 4,512,484 | 4/1985 | Mar . | |
| 4,572,385 | 2/1986 | Luker . | |
| 4,687,112 | 8/1987 | Swartzbaugh . | |
| 4,752,013 | 6/1988 | Miller et al. . | |
| 4,752,014 | 6/1988 | House et al. | 215/216 |

*Primary Examiner*—Allan N. Shoap
*Assistant Examiner*—Nathan Newhouse
*Attorney, Agent, or Firm*—Harpman & Harpman

[57] ABSTRACT

A safety locking screw cap and container having locking projections on the container that are registerable with a flexible flange arm extending from the screw cap to prevent rotation and removal of the cap relative the container. The cap may be removed from the container by flexing the flanged arm away from the cap by pressing on a portion of the flanged arm thus clearing the locking projection allowing removal rotation of the cap on the threaded neck of the container.

5 Claims, 2 Drawing Sheets

SAFETY LOCK SCREW CAP AND CONTAINER

BACKGROUND OF THE INVENTION

1. Technical Field

This device relates to child resistant and safety closure caps used to restrict removal of the closure from a container without a specific two-part manipulation of the closure which is difficult for a child to accomplish.

2. Description of Prior Art

Prior art devices of this type have relied on a variety of different safety closure configurations that require closure manipulation to release the closure for removal, see for example U.S. Pat. Nos. 3,233,769, 3,941,268, 3,944,101, 4,512,484, 4,572,385, 4,687,112, 4,752,013.

In U.S. Pat. No. 3,233,769 a screw cap container and safety device is disclosed wherein a cap is provided with a tab-like projection that is registerable with an element on the container restricting its rotation and removal therefrom.

U.S. Pat. No. 3,941,268 is directed towards a safety closure and container having a flexible closure body with an internal locking lug that engages a cam projection on the neck of the container. The closure body is distorted by squeezing the closure moving the locking lug from engagement with the camming projection.

Referring to U.S. Pat. No. 3,944,101 a safety closure is disclosed having a cap body with a depending annular wall, the lower edge of which has sets of angular teeth extending therefrom which are engageable with matching teeth formed on the container's shoulder restricting rotation of the closure.

U.S. Pat. No. 4,512,484 is directed towards a locking screw cap having a removable safety tab registerable with a bracket on the sidewall of the cap and is engageable with upstanding tabs on the container's shoulder to prevent unauthorized rotation.

A tamper indicating child resistant threaded closure can be seen in U.S. Pat. No. 4,572,385 in which a tab extends from the closure and a detachable projection which can be removed from the closure allowing rotation of the closure and removal from the container.

Referring to U.S. Pat. No. 4,687,112 a child resistant package is disclosed having a cap with a depending flange that registers with a notch on the container preventing rotation. Deflection of the cap disengages same with the notch allowing the cap to rotate for removal.

Finally, U.S. Pat. No. 4,752,013 a tamper evident child resistant cap and bottle is disclosed that is directed towards a pair of ark segments with downwardly extending ratchet dogs engageable on the neck of the bottle preventing unauthorized rotation and removal.

SUMMARY OF THE INVENTION

This invention is directed to child resistant closures and containers on which they are used to seal the container and to prevent tampering by children due to the multiple step process required to effect free rotation of the closure for removal from the container. The closure has a resilient flanged arm that registers against a locking lug on the container and requires deliberate depression of a portion of the flange arm so as to deflect the remaining portion away from the closure clearing the locking lug, thus allowing rotation of the closure and removal of same from the container.

DESCRIPTION OF THE PREFERRED EMBODIMENT

Figure 1:
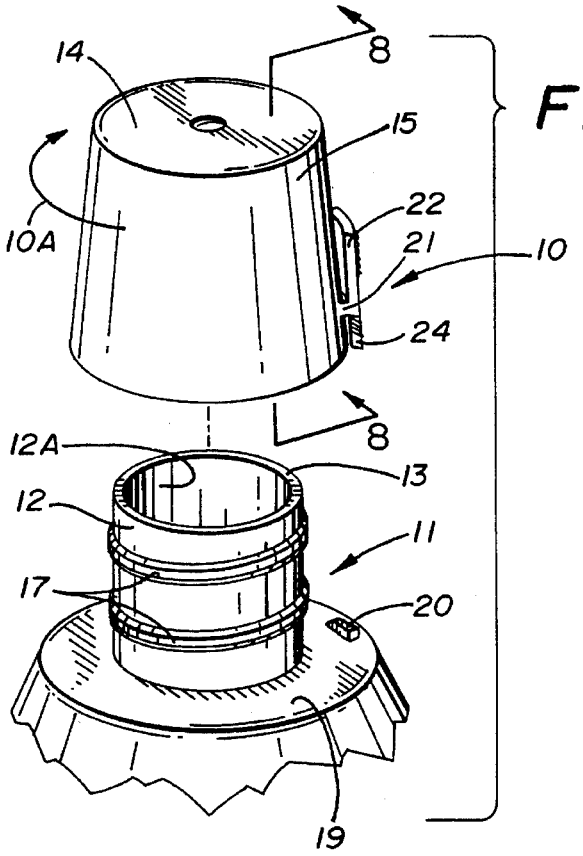
FIG. 1 is an exploded perspective view of the closure and a portion of the container on which it is to be positioned.

Referring to FIGS. 1, 2, 4 and 8 of the drawings, a child resistant closure 10 and container configuration 11 can be seen. The container 11 has a neck portion 12 that denotes an opening 12A of the container 11 terminating in a rim 13.

The closure including a top portion 14 with a depending annular sidewall 15 having a single internal spiral thread 16 extending outwardly from its inner wall surface thereof. The internal threads 16 are engageable with complimentary threads 17 on the container neck 12 to secure the closure 10 to the container 11 from which it extends. The closure depending annular sidewall 15 is tapered outwardly from said top portion 14 so as to be in horizontally spaced relation to the lower portion of the neck configuration 12 indicated at 18 which terminates on a shoulder portion 19 of the container 11 below the neck 12, best seen in FIG. 1 of the drawings. The shoulder portion 19 has an upstanding nub stop 20 extending therefrom in horizontally spaced relation to the hereinbefore described neck 12.

Figure 2:
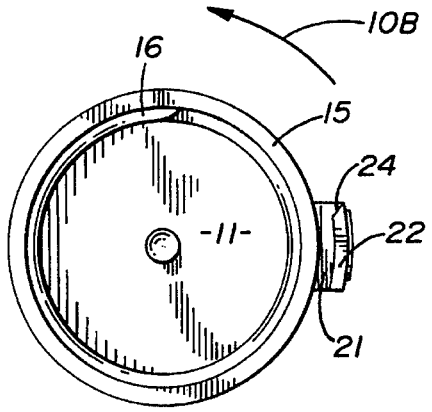
FIG. 2 is a bottom plan view of the closure.
Figure 3:
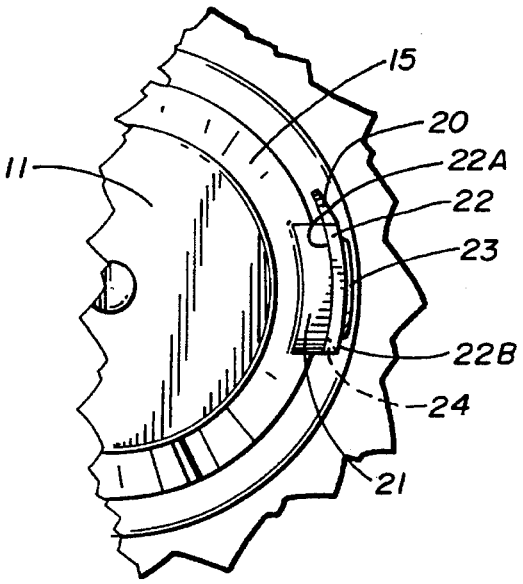
FIG. 3 is an enlarged top plan view of a portion of the closure illustrating the release arm and locking lug.

The annular sidewall 15 has a radially projecting support tab 21 from which extends to a release arm 22 in spaced parallel relation to said annular sidewall 15. The release arm 22 is of a transversely arcuate configuration with an upper portion 22A being above said point of attachment with said support tab 21 and a lower portion 22B extending below said support tab 21 to adjacent the shoulder portion 19 of the container 11. The release arm 22 has a ribbed engagement area 23 on its upper portion 22A and is tapered along its lower portion's 22B vertical edge 24 as best seen in FIG. 2 of the drawings to provide interengaging contact with the upstanding nub stop 20 during rotational positioning of the closure on the neck portion 12.

Figure 8:
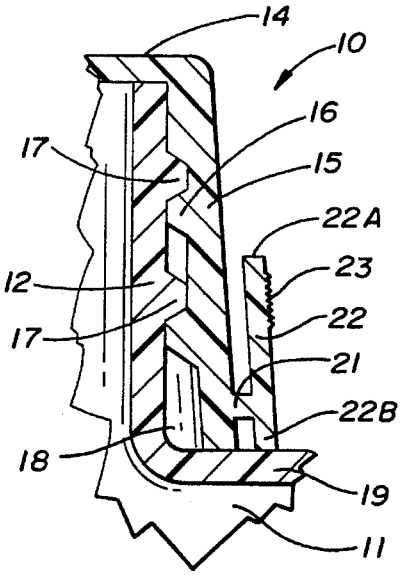
FIG. 8 is a enlarged sectional view of a portion of the closure on the container as seen in FIG. 3 in assembled position.

In operation, the closure 10 is rotatably positioned on the neck portion 12 of the container 11 by clockwise rotation as is illustrated in FIG. 1 of the drawings by directional arrow 10A. The respective closure thread 16 and neck thread 17 registerably engage drawing the closure 10 down onto the neck 12 until initial engagement occurs between the lower portion 22B's edge 24 of the release arm 22 and the upstanding nub stop 20 whereupon the release arm's tapered edge 24 cams away and around the locking nub 20 allowing complete rotation and sealing of the closure 10 on the neck 12 as seen in FIG. 8 of the drawings.

Figure 4:
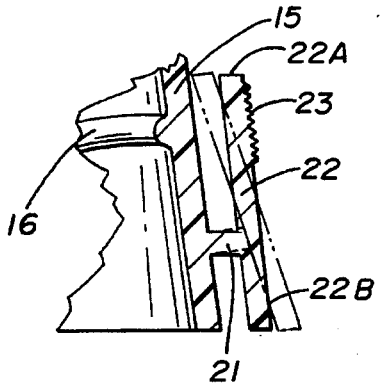
FIG. 4 is an enlarged sectional view of a portion of the closure shown in FIG. 3.
Figure 5:
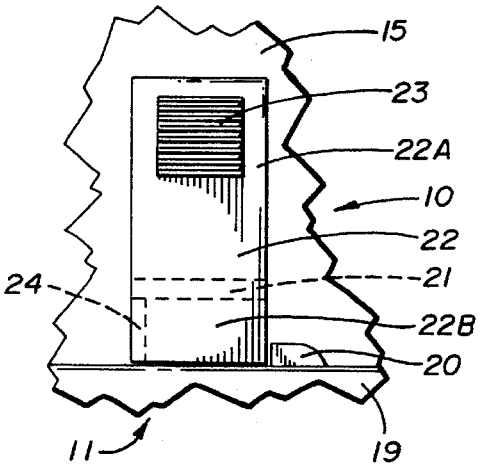
FIG. 5 is an enlarged side elevational view of the release arm of the closure shown in FIG. 3.

Referring now to FIGS. 1, 4, and 5 of the drawings, the removal of the closure 10 is illustrated which requires the depressing of the upper portion 22A of the release arm 22 indicated by the ribbed engaged area 23 deflecting the release arm's upper portion 22A as shown in broken lines in FIG. 4 horizontally offsetting the respective lower portion 22B of the release arm 22 outwardly from the neck portion 12 clearing the upstanding nub stop 20 allowing counter clockwise rotation of the closure 10 as indicated by the directional arrow 10B removing the closure from the neck portion 11 as will be evident to those skilled in the art.

During the deflection of the release arm 22, the support flange 21 acts as a fulcrum between the upper and lower portions 22A and B respectively to affect the required outward deflection of the arm's lower portion 22B for clearance of the hereinbefore described upstanding nub stop 20.

Figure 6:
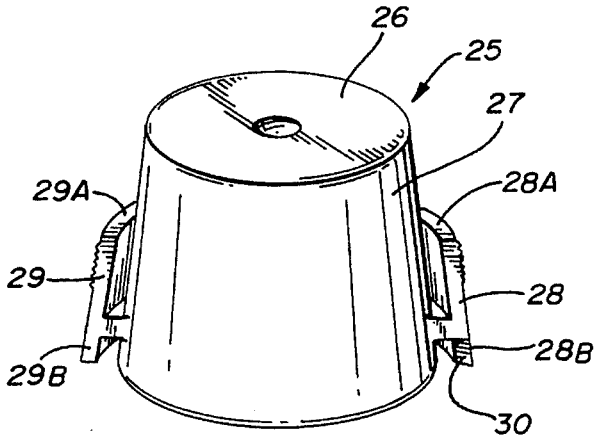
FIG. 6 is a perspective view of an alternate form of the invention illustrating dual release arms.
Figure 7:
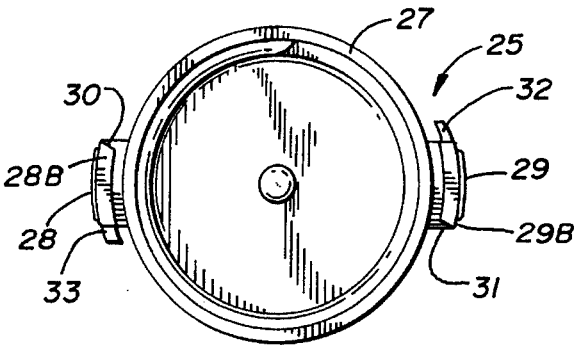
FIG. 7 is a bottom plan view of the closure illustrated in FIG. 6.

Referring now to FIG. 6 and 7 of the drawings, an alternate form of the invention is illustrated wherein a threaded closure 25 is seen having a top 26, an annular depending sidewall 27 and two oppositely disposed release arms 28 and 29 respectively positioned thereon. Each of said release arms 28 and 29 are generally of an identical structural configuration to said preferred embodiment and closure configuration release locking arm 22 having respective upper and lower portions 28A and B and 29A and B with respective tapered vertical edges 30 and 31 on the lower portions 28B and 29B. It will be seen that the tapered vertical edges 30 and 31 are offset in relation to one another so as to be engageable during closure placement and clockwise rotation with respective upstanding nub stops 32 and 33 as illustrated in FIG. 7 of the drawings It will be readily apparent that the critical requirement for removal of the alternate closure configuration 25 is that both of the respective release arms 28 and 29 upper portions 28A and 29A be squeezed simultaneously so as to clear the respective upstanding nubs 32 and 33 allowing effective counter clockwise rotation of the closure 25 for removal.

Thus, it will be seen that an improvement in a child safety closure and container has been illustrated and described and that various changes and modifications may be made therein without departing from the spirit of the invention.

Therefore I claim:

1. An improvement in a safety closure and container, said container having a cylindrical upstanding neck portion with threads formed on the exterior thereof, shoulder portion extending from the neck portion, the closure having a top and a tapered annular depending sidewall extending therefrom, with an inturned thread for registration with said continuous neck portion, the improvement comprises in combination at least one locking release arm extending from said angular depending sidewall, at least one upstanding locking nub extending from the shoulder portion of the container in horizontally spaced relation to said neck portion, a radially projecting support tab extending from said annular sidewall to said locking release arm, a locking release arm upper portion and a locking release arm lower portion positioned thereon, said locking release arm lower portion aligned for engagement with said locking nub to prevent the removal of said closure from said container when said closure is in threaded engagement with said neck, said locking release arm's upper portion is of a known vertical dimension and said locking release arm's lower portion is of a vertical dimension less than that of said locking release upper portion, and said support tab being flexible to permit deflection of the locking release upper portion inwardly towards said annular sidewall providing outwardly deflection of said release locking arm's lower portion beyond said locking nub to allow rotation of said closure cap from said engagement with said closure.

2. The improvement in a safety closure and container combination of claim 1 wherein said locking release arm has a tapered vertical edge surface defining a camming engagement against said upstanding locking nub during clockwise rotation of said closure onto said container neck.

3. The improvement in a safety closure and container combination set forth in claim 1 wherein said release locking arm is transversely arcuate to conform with said closure's annular sidewall.

4. The improvement in a safety closure and container, the container having a cylindrical neck portion with threads formed on the exterior thereof, the closure having a top and a downwardly tapered internally threaded annular sidewall depending therefrom for registration with said container neck portion, the improvement comprises in combination a pair of oppositely disposed locking release arms extending from said sidewall, upstanding locking nubs on said shoulder portion of said container in spaced relation to said neck portion and in aligned registration with said respective locking release arms, radially projecting support tabs extending from said annular sidewall to said respective opposing release arms defining locking release upper and lower portions extending therefrom, said locking release arm's lower portion engageable with said respective upstanding locking nubs when said closure is fully threaded onto said neck of said container, each of said locking release arms having tapered parallel vertical edges, one of said edges on each of said locking release arms being tapered to define a camming surface engageable on said respective locking nubs during closure placement on said neck in a clockwise rotational manner.

5. The improvement in a safety closure and combination set forth in claim 4 wherein said respective tapered edges on said locking release arms are in oppositely disposed angular offset relation to one another.

* * * * *